US006585583B1

(12) United States Patent
Chan

(10) Patent No.: US 6,585,583 B1
(45) Date of Patent: Jul. 1, 2003

(54) EMERGENCY AIR SUPPLY DEVICE FOR FIRE ACCIDENT

(76) Inventor: Der-Long Chan, P.O. Box 7-820, Taipei (TW)

( * ) Notice: Subject to any disclaimer, the term of this patent is extended or adjusted under 35 U.S.C. 154(b) by 0 days.

(21) Appl. No.: 10/189,849

(22) Filed: Jul. 8, 2002

(51) Int. Cl.[7] ..... A62C 2/06
(52) U.S. Cl. ..... 454/257; 454/902
(58) Field of Search ..... 454/369, 257, 454/902

(56) References Cited

U.S. PATENT DOCUMENTS 1,755,834 A * 4/1930 Marr et al. ..... 116/214
3,916,566 A * 11/1975 Lacombe ..... 49/7
4,928,583 A * 5/1990 Taylor et al. ..... 454/236
4,936,388 A * 6/1990 Le Lande, Jr. ..... 169/46
5,507,283 A * 4/1996 Grivas ..... 128/205.25
5,855,510 A * 1/1999 McKenzie ..... 454/342

* cited by examiner

*Primary Examiner*—Derek Boles

(57) ABSTRACT

The present invention provides an air supply device for fire accident, comprising an air supply pipe covered by a protective insulating layer buried at the bottom of a cement wall in the building, and such pipe tube having an air valve and an indicating sign at appropriate interval along the pipe for the survivors to obtain oxygen by hooking up the pipe. Air supply pipe in different areas has different color and is connected to the external air supply pipe of the building, and a pressure gauge and buzzer are set in the front of the connection such that the alarm of the buzzer gives indication of the correct location of air supply pipe to the survivors; the middle section of the external air supply pipe has an emergency air supply valve for timely supplying the highly pure oxygen for the survivors, and a U-shaped pipe having internal filter for purifying the air is disposed at other end to rapidly supply fresh air for the victim for a long-time survival, and further gives the correct direction to exit the fire site. Such structure greatly increases the chance of getting rescued from the fire site.

1 Claim, 6 Drawing Sheets

EMERGENCY AIR SUPPLY DEVICE FOR FIRE ACCIDENT

BACKGROUND OF THE INVENTION

1. Field of the Invention

The present invention provides an emergency air supply device for fire accident, comprising an air supply pipe covered by a protective insulating layer buried at the bottom of the inner and outer cement wall in the building, and such pipe has an air supply valve and an indicating sign at appropriate interval along the pipe for the survivors to obtain oxygen by hooking up the pipe. Air supply pipe in different areas has different color and is connected to the external air supply pipe of the building, and a pressure gauge and buzzer are set in the front of the connection, such that the alarm of the buzzer gives indication of the correct location of air supply pipe to the survivors; the middle section of the external air supply pipe has an emergency oxygen supply valve for rescuers to timely supply the highly pure oxygen for the survivors, and an internal filter within the U-shaped pipe curving upwards at the other end purifies the air to rapidly supply fresh air for the survivors for a long-time survival, and further gives the correct direction with indicating signal to help to escape from the fire site. Such structure greatly increases the practical effect of successfully rescuing survivors from the fire site.

2. Description of the Prior Art

Generally in the fire accidents, besides the dense smoke that hastens the deterioration of the air, it also puts survivors in the situation of losing their direction and the important oxygen for survival. The smoke generally makes the survivors suffocated and dead for the lack of oxygen before they can escape from the fire, and the smoke also deprives the possible chance for the escape. Although the current fire protection training is promoting the measure of covering one's mouth and noise with wet towels as well as lowering the body to get away from the dense smoke, which helps to escape alive from the fireplace, yet it's only useful in small fire accidents. Once a large fire extends and the smoke spreads in the lower layer around the fire site, it is unable to put such method into practice, particularly in the situation with chemical toxic gases mixed in the smoke. Therefore, simple anti-smoke mask equipment is also introduced in the present times. However, depending on different level of dense smoke, such mask has the limitation and shortcoming of life span. Therefore, the method of how to maintain alive and wait for the rescuers in a fire has become an urgent topic for the industries to break through and innovate.

SUMMARY OF THE INVENTION

The primary objective of the present invention is to provide an emergency air supply device for fire accidents to maintain one's life, which particularly relates to the combination of an air supply pipe, an insulating layer, a pressure gauge, a buzzer, an emergency oxygen supply valve, a waterproof hood, a filter, an air supply valve, a check valve, an expansion valve and etc., such that the survivors can obtain oxygen rapidly for a long-time survival. It further gives indicating signals of the correct direction to escape from the fire site, and greatly improves the chance of getting rescued from the fire site The secondary objective of the present invention provides an emergency air supply device for fire accidents to maintain one's life, with a plurality of air valves and indicating signals at appropriate intervals of the pipe to facilitate the survivors to obtain oxygen gas rapidly for a long-time survival during a fire.

A further objective of the present invention is to provide an emergency air supply device for fire accidents to maintain one's life, which also relates to that the pipes of different areas are extended respectively with different diameters and colors to connect the external air supply pipe of the building, and a pressure gauge and a buzzer are disposed in front of the connection of the pipe, such that the alarm of the pressure gauge gives the correct location of the survivors.

Another objective of the present invention is to provide an air supply device for fire accidents to maintain one's life, which refers to an emergency air supply valve in the middle section of the external air supply pipe for timely supplying highly pure oxygen gas for the survivors' long-time survival.

DELTAILED DESCRIPTION OF THE PREFERRED EMBODIMENT

Figure 1:
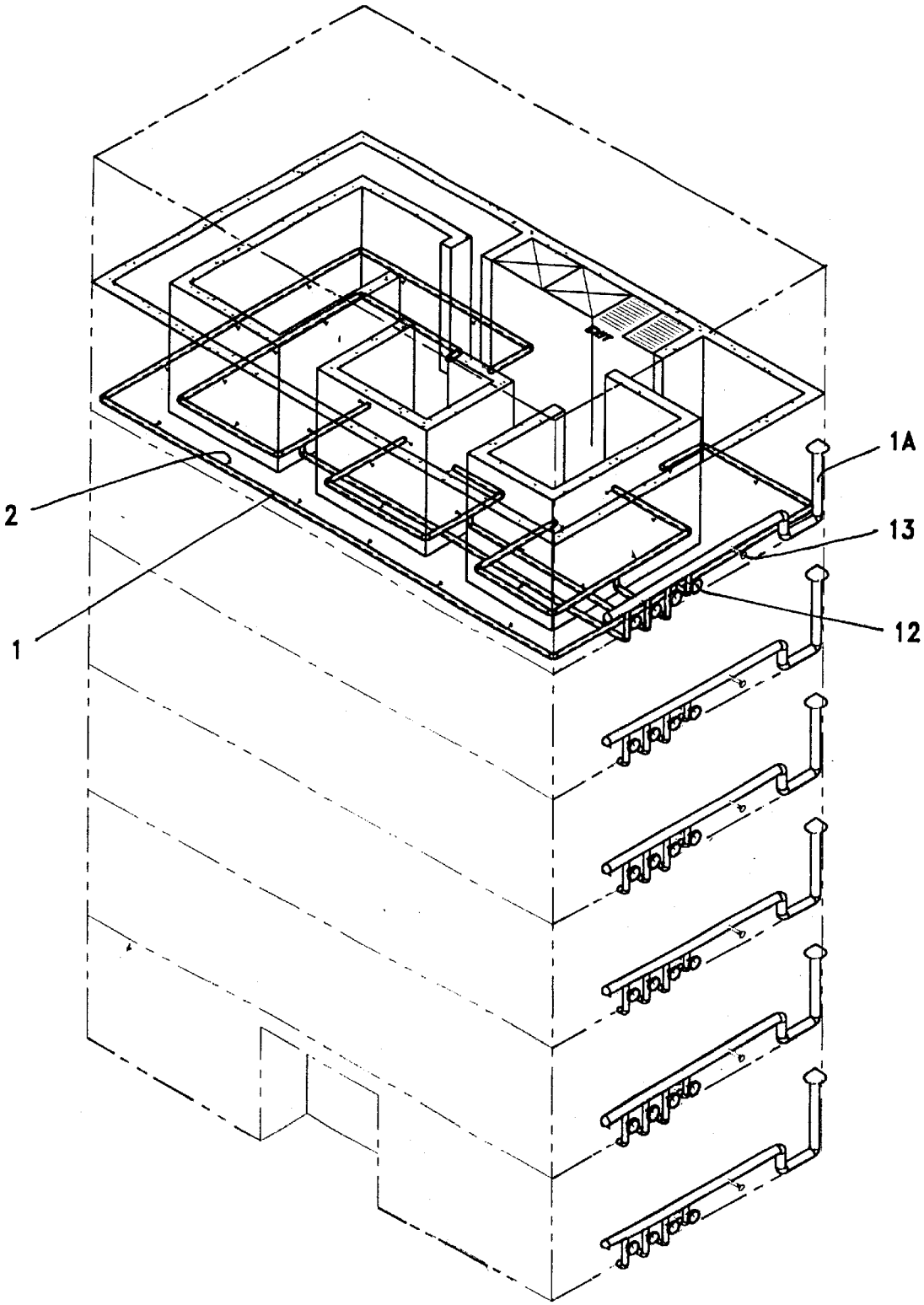
FIG. 1 is a diagram of a preferred embodiment of the present invention.
Figure 2:
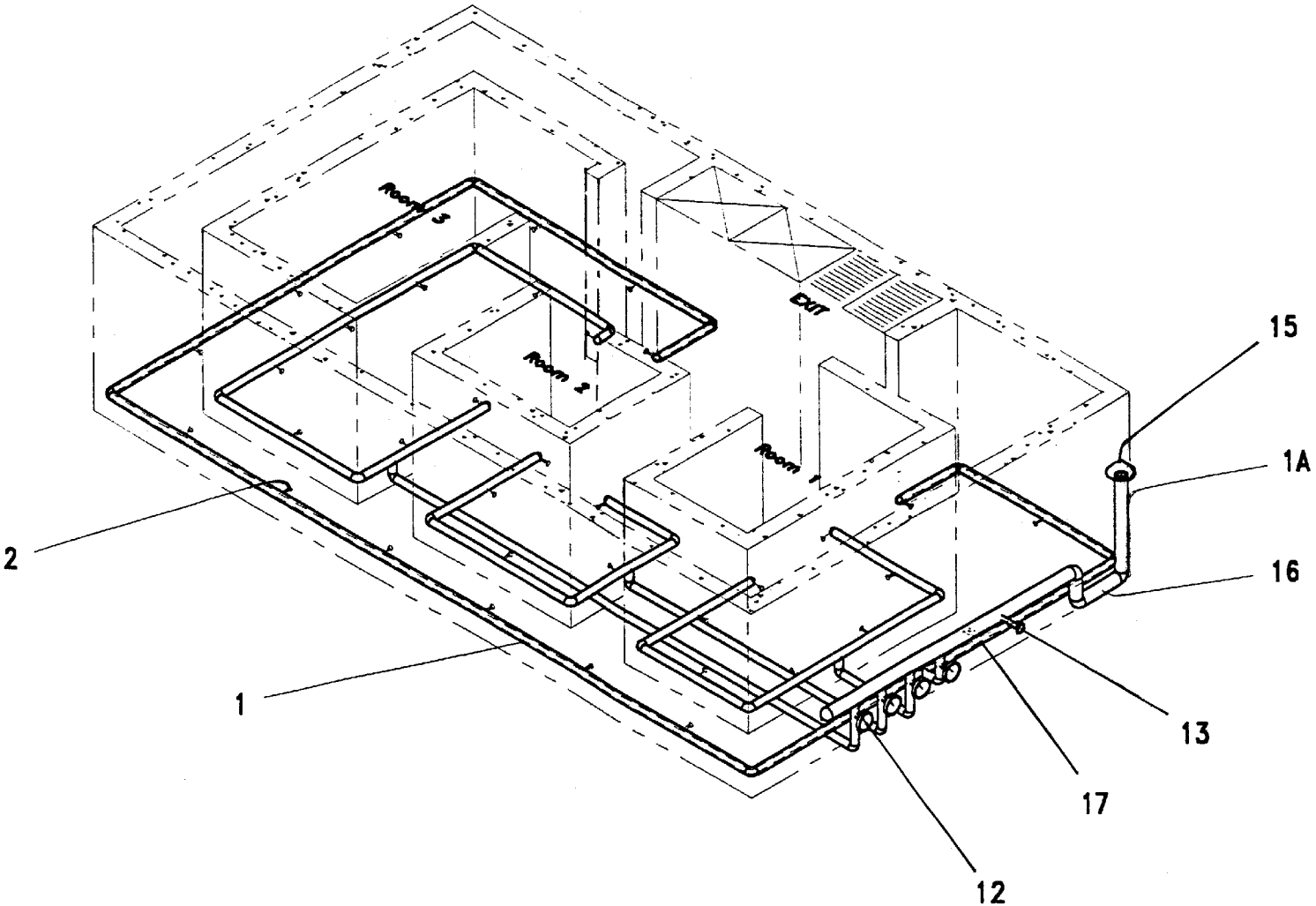
FIG. 2 is a three-dimensional picture showing the structure of the present invention.
Figure 3:
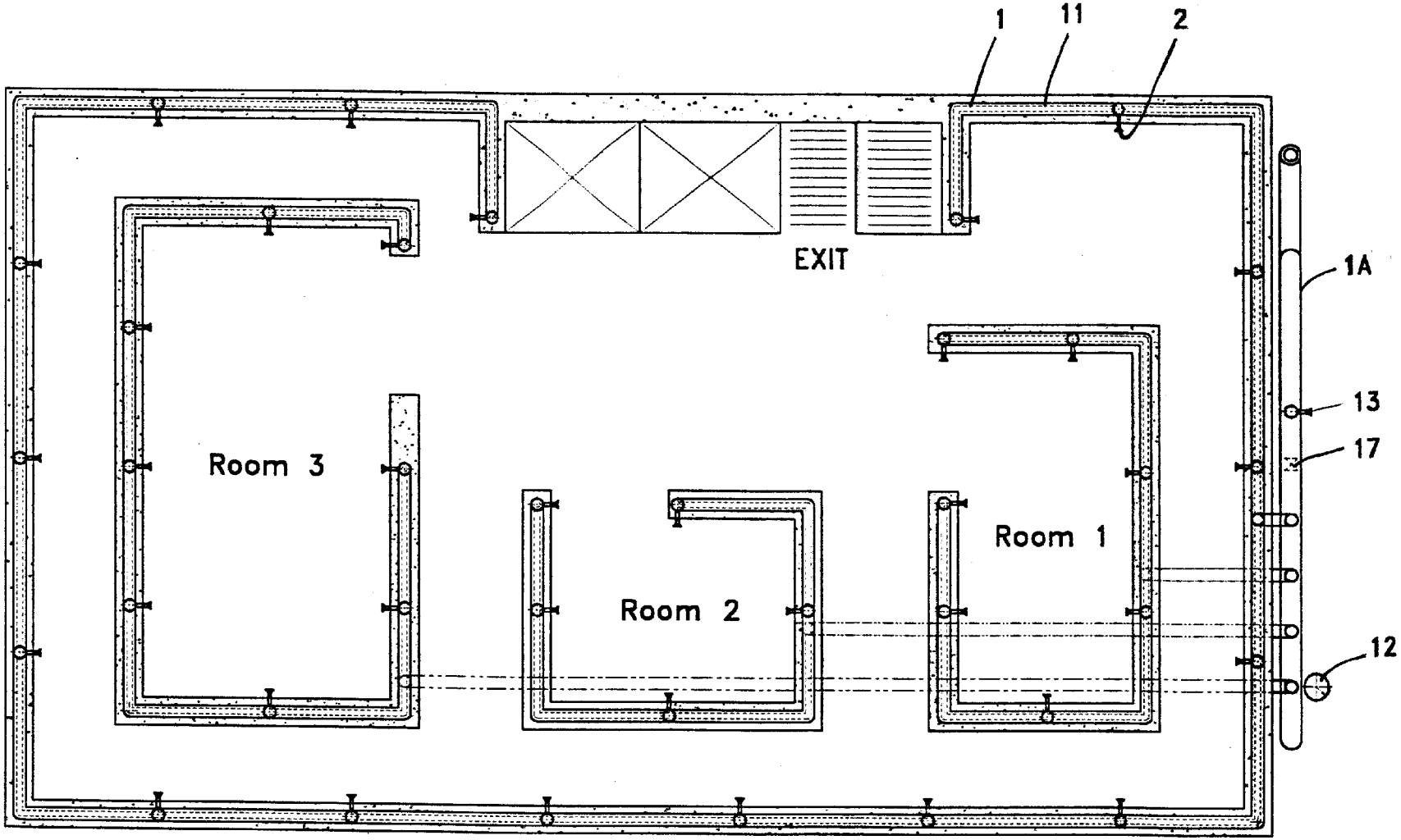
FIG. 3 is a bottom-view diagram of the structure of the present invention.
Figure 4:
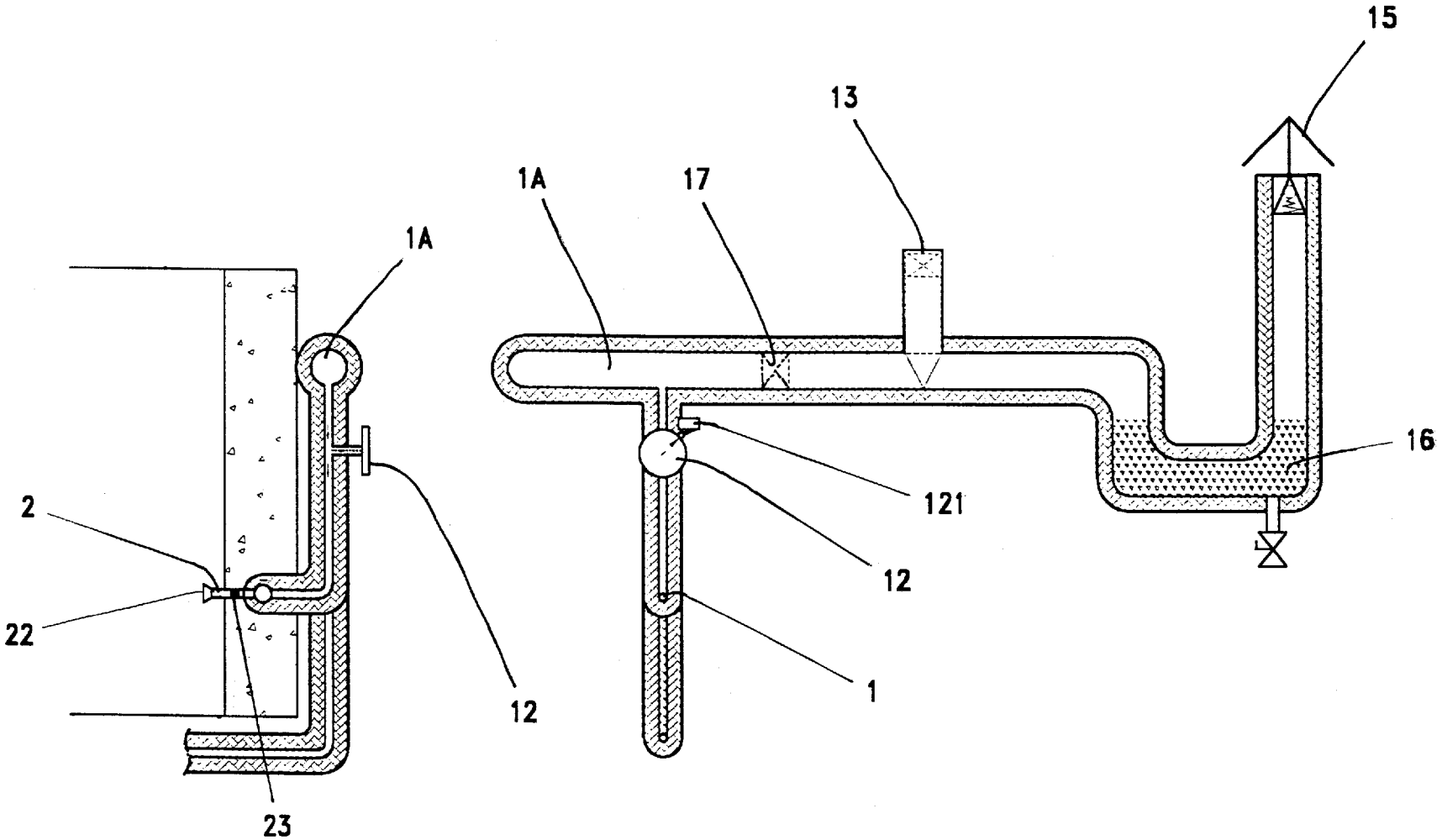
FIG. 4 is a cross-sectional diagram of the external wall according to the present invention.
Figure 5:
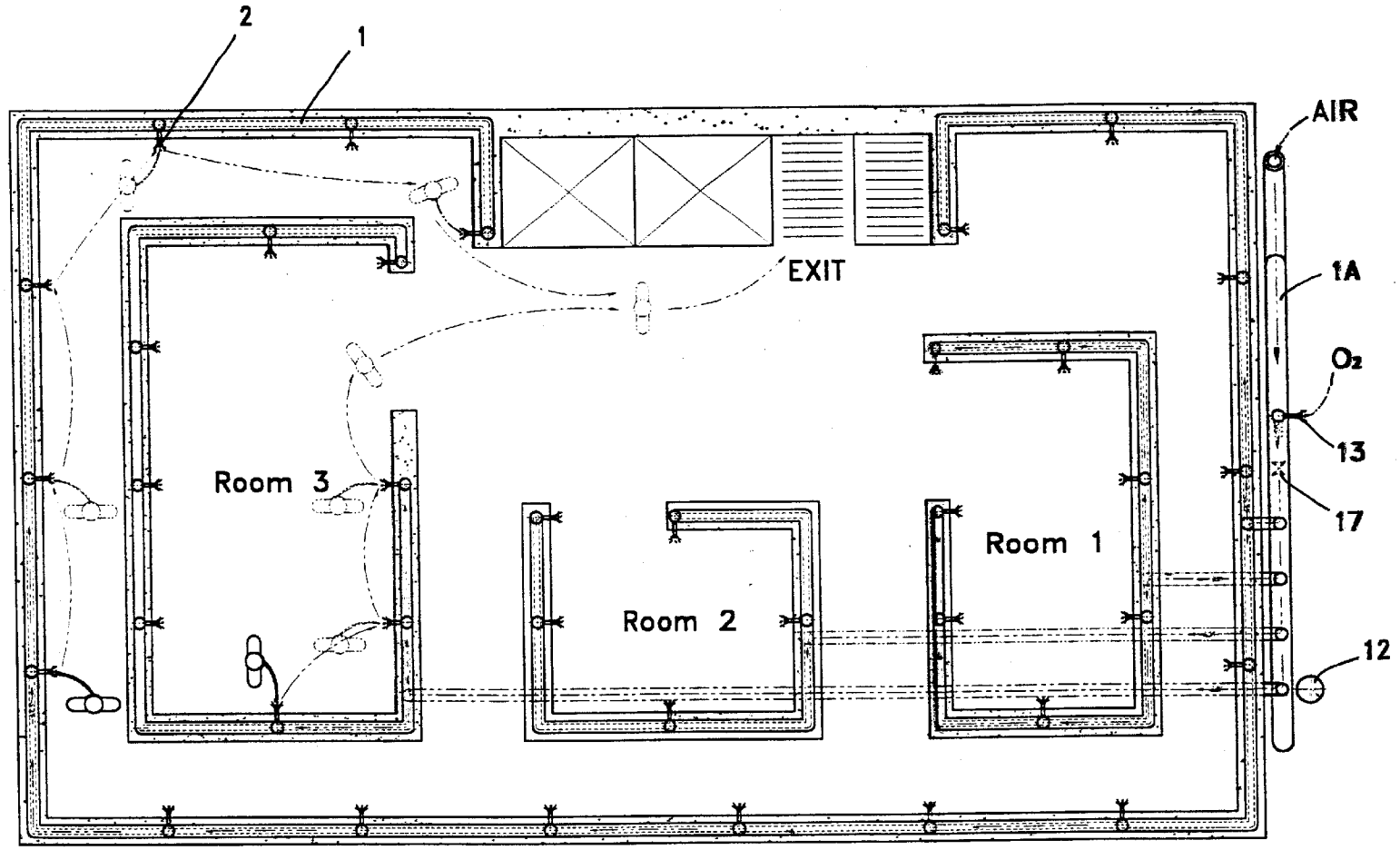
FIG. 5 is a diagram illustrating the function of a preferred embodiment of the present invention.
Figure 6:
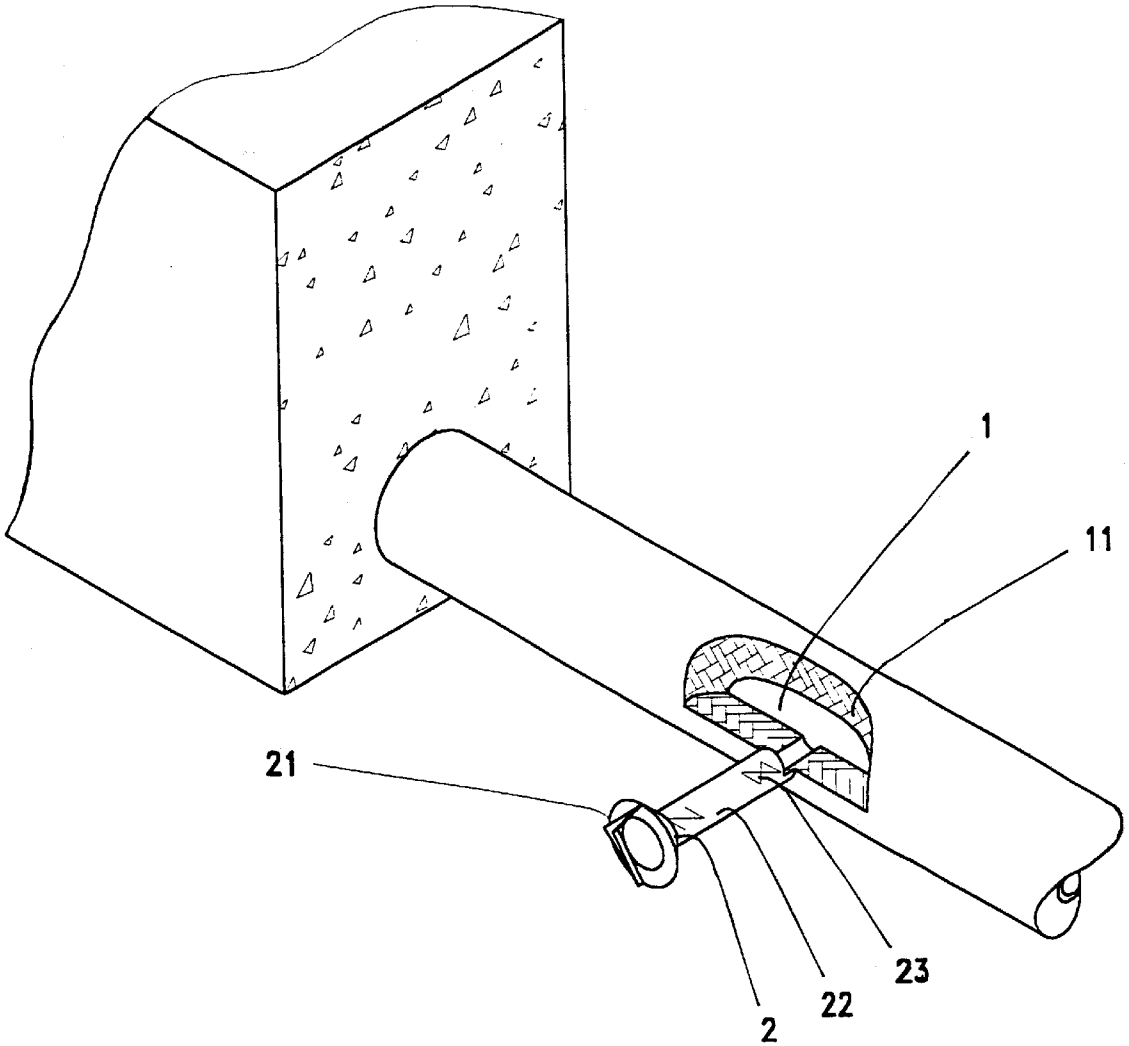
FIG. 6 is a diagram showing the enlarged cross-sectional diagram of the air supply valve of the present invention.

Referring to FIGS. 1 to 6, the air supply device for fire accidents of the present invention comprises an air supply pipe 1, an insulating layer 11, a pressure gauge 12, a buzzer 121, an emergency air supply valve 13, a waterproof hood 15, a filter 16, a check valve 17, an air supply valve 2, an indicating sign 21, a check valve 22, and an expansion valve 23; wherein the air supply pipe 1 is a hollow pipe covered by an insulating layer 11 with appropriate thickness, and buried into the inner and outer parts of the wall at an appropriate height from the floor of the building. The pipe has different colors in different areas along the wall and floor of the building, and is connected to an external air supply pipe 1A; wherein a pressure gauge 12 and a pressure sensing buzzer 121 are disposed in front of each connection of the pipe; an emergency oxygen valve 13 is set in the middle section of the external air supply pipe 1A and a U-shaped pipe opening set at another end has a waterproof hood 15 and a built-in filter 16; a check valve 17 is set between the oxygen valve and each connection; the air supply valve 2 is a pipe substantially in the shape of an trumpet opening with an indicating sign 21 for directions, and such pipe has a check valve 22 and a temperature sensing expansion valve 23 at the rear position inside the cement wall. The pipe opening at the rear end may have air supply pipe 1 soldered in each area as needed, which is the main implementation structure of the present invention.

The implementation of the present invention makes use of the air supply valve 2 evenly distributed in each air supply pipe 1 of each area to facilitate the survivors to connect to the valve during a fire with strong smoke in order to obtain purified air from the outside of the building via the filter 16. When the air flows through the check valve 17 and the pressure gauge 12, it triggers the buzzer 121 to give alarm, so that the rescue team notice the survivors waiting for help in the area, so as to locate the survivors and rescue them at the shortest possible time, and thus increases the chance of survival. Survivors can easily follows the correct direction given by the indicating sign 21 to escape from the fire site. In addition, the emergency oxygen valve 13 timely supplies highly pure oxygen gas depending on the rescuer's need. Further, when the temperature of the fire exceeds the upper limit due to the burning of the expansion valve 23 within each air supply valve in the related area and may endanger human life, the air supply valve 23 in the area of the fire will be shut to protect the survivors from inhaling a high-temperature gas, and provides them a long-time survival for the survivors and further indicates the correct direction by signs to help escape from the fire. The alarm of the buzzer also gives promptly the correct location of the survivors, so that the rescue team can take action immediately. Such arrangement greatly increases the chance of getting rescued in a fire situation.

While the invention has been described by means of specific embodiments, numerous modifications and variations could be made thereto by those skilled in the art without departing from the scope and spirit of the invention set forth in the claims.

What is claimed is:

1. An emergency air supply device for fire accident, comprising an air supply pipe, an insulating layer, a pressure gauge, a buzzer, an emergency oxygen supply valve, a waterproof hood, a filter, a check valve, an air supply valve, an indicating sign, a check valve, and an expansion valve; wherein:

the air supply pipe is a hollow pipe covered by an insulating layer of an appropriate thickness, and buried into the inner and outer parts of the wall at an appropriate height from the floor of the building; the pipe has different colors in different areas along the wall and floor of the building, and is connected to an external air supply pipe; wherein a pressure gauge and a pressure sensing buzzer are disposed in front of each connection of the pipe, and an emergency oxygen valve is set in the middle section of the external air supply pipe and a U-shaped pipe opening set at another end with a waterproof hood and a built-in filter; a check valve is set between the oxygen valve and each connection; the air supply valve is a pipe substantially in the shape of a trumpet opening comprising an indicating sign for giving directions, and such pipe has a check valve and a temperature sensing expansion valve at the rear position inside the cement wall; the pipe opening at the rear end comprises an air supply pipe soldered in each area as needed;

wherein the foregoing arrangement facilitating survivors to connect to the valve for obtaining purified air via the filter during a fire by means of the evenly distributed air supply valve of the air supply pipe in each area of the building, and in the meantime, giving correction direction to the survivors to escape from the fire site; the emergency oxygen valve providing highly pure oxygen for rescuers as needed; the sensing expansion valve being capable of sensing and preventing the survivors from inhaling the high-temperature gas by shutting the valve; when the air passing through the check valve and the pressure gauge, buzzer being triggered to give alarm and allowing the rescuer to locate the exact position of the survivors and enabling them to rescue the survivors at the shortest possible time; further giving the correct direction for the survivors to escape from the fire site, and allowing the rescuer to follow the buzzer alarm for the rescuer, and thus greatly increasing the chance of the survival.

* * * * *